US005867845A

United States Patent [19]

Fangmann

[11] Patent Number: 5,867,845

[45] Date of Patent: Feb. 9, 1999

[54] BEDPAN APPARATUS

[76] Inventor: Norine Fangmann, 15 Pleasant La., Green Pond, N.J. 07435

[21] Appl. No.: 891,663

[22] Filed: Jul. 11, 1997

[51] Int. Cl.[6] ..... A61G 9/00

[52] U.S. Cl. ..... 4/456

[58] Field of Search ..... 4/456

[56] References Cited

U.S. PATENT DOCUMENTS

| | | | |
|---|---|---|---|
| 1,924,204 | 8/1933 | Young | 4/456 |
| 5,079,788 | 1/1992 | Raupp | 4/456 X |
| 5,136,733 | 8/1992 | Church | 4/456 |

FOREIGN PATENT DOCUMENTS

| | | | |
|---|---|---|---|
| 584222 | 2/1925 | France | 4/456 |

*Primary Examiner*—Robert M. Fetsuga

*Attorney, Agent, or Firm*—Kenyon & Kenyon

[57] ABSTRACT

An improved bedpan apparatus is disclosed, including a bedpan having a base and a wall defining a receptacle, and a lip which can support a person; and a bedpan cushion coupled to the bedpan on the lip. The apparatus also can include a layer of material which provides frictional resistance to movement of the cushion on the lip. The apparatus can be provided with a retainer, such as an elastic material, for retaining the cushion on the lip. The apparatus also can be provided with one or more tabs which are coupled to the cushion and engage the bedpan for retaining the cushion on the bedpan.

17 Claims, 3 Drawing Sheets

BEDPAN APPARATUS

FIELD OF THE INVENTION

This invention relates to bedpans, and more particularly to a bedpan apparatus including a cushioned support for a bedpan.

BACKGROUND OF THE INVENTION

Bedridden people often are incapable of using standard toilet facilities. Typically, such people use bedpans, which can be placed under the person when required. In the past, bedpans typically were made of metal. Although metal bedpans are still in use, many hospitals and long-term healthcare facilities use bedpans made from plastics. The plastic materials must be rigid in order to support the person and maintain a receptacle. However, the rigidity of the bedpans often leads to discomfort to the user. Many people remain on the bedpan for extended periods of time. In addition, since the people who use bedpans often have serious illnesses, or are elderly, many have little muscle support, which causes painful compression of bones on the rigid bedpan. In some instances, the person's discomfort leads to an effort to remove the bedpan without the assistance of a healthcare worker, which can cause spilling of the bedpan contents. In other instances, discomfort has lead to the person having the bedpan undesirably removed prematurely. It also has been found that some people develop gluteal sores due to the rigidity of the bedpan. Thus, there is need for an improved bedpan apparatus which will retain its essential functionality while alleviating the discomfort many people experience.

OBJECTS AND SUMMARY OF THE INVENTION

It is an object of this invention to provide an improved bedpan apparatus which will retain its essential functionality, while alleviating the discomfort many people experience.

It is a further object of this invention to provide an improved bedpan apparatus which will provide improved user comfort while minimizing inconvenience to healthcare workers.

It is a further object of the invention to provide an improved bedpan apparatus which will not interfere with the ability to sterilize and re-use the bedpan.

These and other objects of the invention are achieved by a bedpan cushion which can be incorporated with a bedpan to form an improved bedpan apparatus. The bedpan apparatus preferably comprises a bedpan having a base and wall defining a receptacle, the bedpan having a lip on which a user may rest, and a bedpan cushion coupled to the bedpan and positioned on the lip. The cushion may be secured to the bedpan by suitable means, including adhesive tabs, frictional forces, elastic retaining bands, or other securing means.

DETAILED DESCRIPTION OF THE PREFERRED EMBODIMENTS

Figure 1:
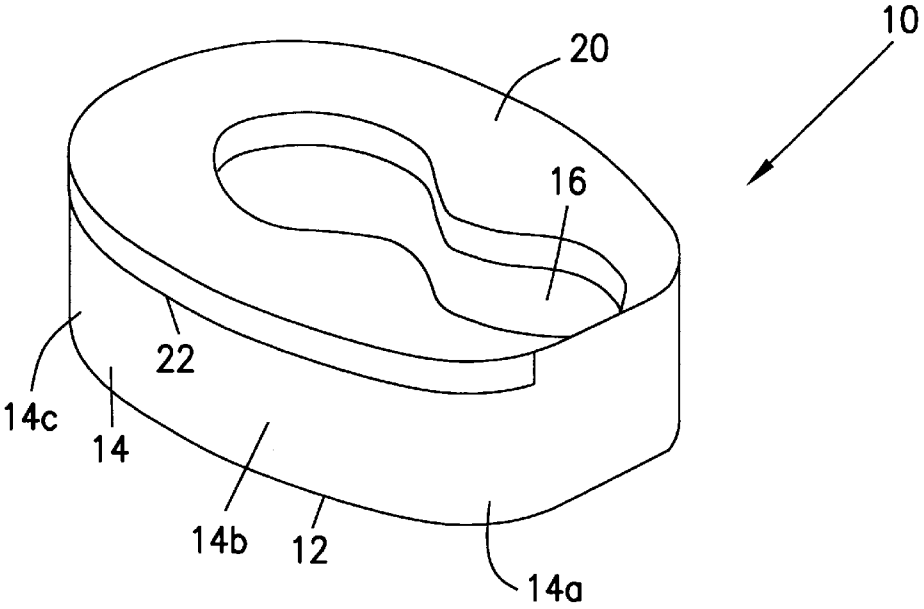
FIG. 1 is a plan view of a bedpan useful in the apparatus of the invention.

FIG. 1 depicts a typical bedpan 10 which has been used in hospitals and healthcare facilities, and which can be used in the apparatus of the invention. Bedpan 10 has a base 12 and a wall 14 extending upwardly from the base. Wall 14 extends around the base in annular fashion so that base 12 and wall 14 define a receptacle 16. Preferably, bedpan 10 is shaped with a somewhat irregular cross-section, to better accommodate a user. Thus, the opening into receptacle 16 preferably is narrower toward the middle section of the wall 14*b* than it is at the ends 14*a* and 14*c* of wall 14. A lip or seat 20 is provided at the top of wall 14, and extends substantially around the entirety of wall 14. Preferably, lip 20 does not extend completely around wall 14, but rather is recessed at end 14*a* of the wall. Lip 20 is constructed and arranged to support a person using the bedpan. A rim 22 extends around the outer edge of bedpan 10, extending downwardly from lip 20. Thus, lip 20 preferably is integral with wall 14 at its radially inner edge, and with rim 22 at its outer edge. Preferably, the distance between wall 14 and rim 22 defines the width of lip 20.

Figure 2:
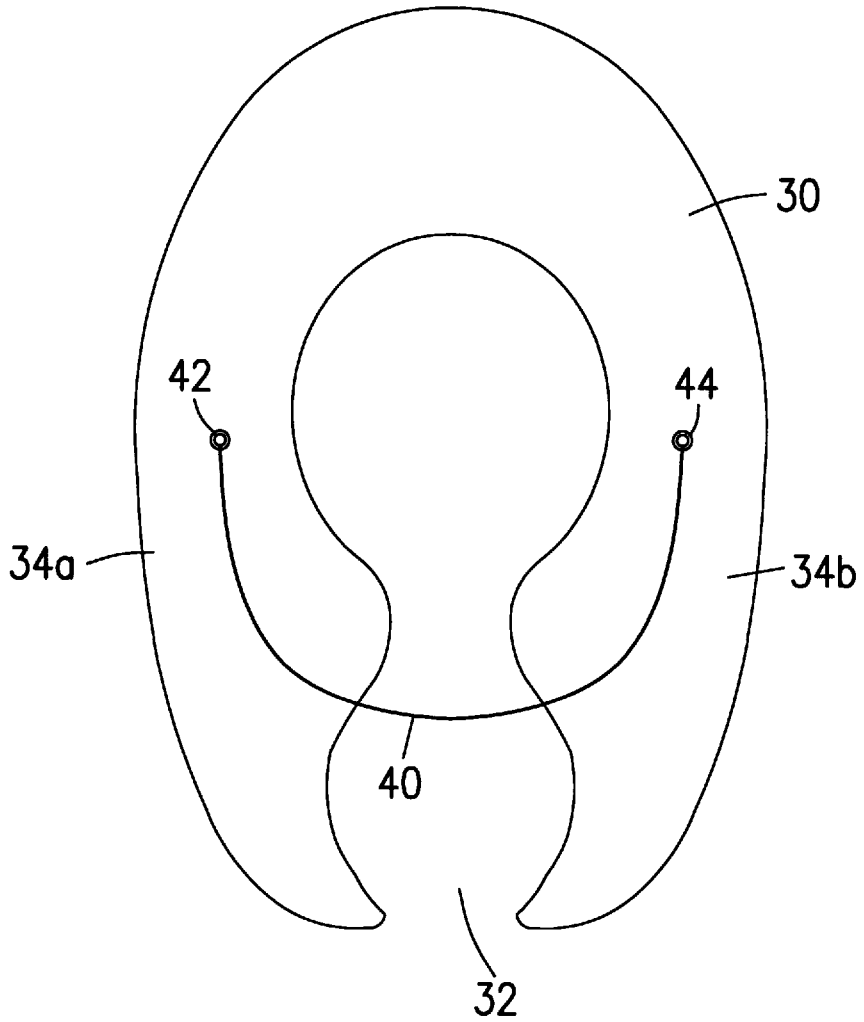
FIG. 2 is a bottom view of a bedpan cushion useful in the apparatus of the invention.

FIG. 2 depicts a bottom view of a preferred bedpan cushion of the invention. Bedpan cushion 30 preferably has a shape which is complementary to the shape of lip 20 of bedpan 10. Cushion 30 is constructed in this embodiment so that when placed on lip 20, it will essentially cover the surface of lip 20. Space 32, located between arms 34*a* and 34*b*, preferably is commensurate with the opening defined by wall 14 for bedpan receptacle 16.

Bedpan cushion 30 preferably is made from a resilient foam material, which can be open-celled or closed-celled. Preferably, the foam is a urethane foam. The thickness of cushion 30 can vary depending on factors such as the nature of the material used and the degree of cushioning desired. Preferably, the cushion is between about two and three inches thick. The thickness of cushion 30 can be uniform or varied so that, for example, it is thicker toward its closed end than at it open end.

Figure 3:
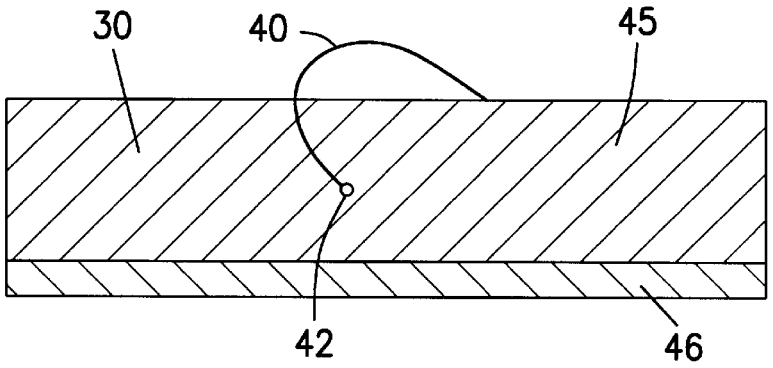
FIG. 3 is a side view of a representative portion of a bedpan cushion useful in the apparatus of the invention.

As shown in FIG. 3, in a particularly preferred embodiment, cushion 30 contains a second layer 46 which is made from a material which is different from the resilient material 45. Second layer 46 can be made of a material which creates frictional resistance when placed in contact with bedpan 10. Thus, layer 46 can assist in resisting slippage or undesired separation of cushion 30 from bedpan 10 after assembly of the apparatus. Preferred materials for layer 46 are polymers such as vinylic materials. Layer 46 can be secured to resilient material 45 by any conventional means, such as adhesive bonding.

In a preferred embodiment, cushion 30 contains a retainer 40 for securing it to bedpan 10. Preferably, retainer 40 is an elastic material which is connected at its ends 42, 44 to cushion 30. Retainer 40 also can be made of a cellulosic material, polymeric material, or any other material which is capable of assisting insecuring cushion 30 to bedpan 10. An elastic material is most preferred. As is shown in FIG. 2, retainer 40 preferably is secured to the bottom of cushion 30, with respective ends 42, 44 connected to arms 34*a*, 34*b* of the cushion. Alternatively, the retainer can be secured to the sides of the cushion (see FIG. 3), or to the top of the cushion.

In a less preferred embodiment, the retainer can be secured to the bedpan so that the cushion can be placed on the bedpan and secured by the retainer.

Figure 5:
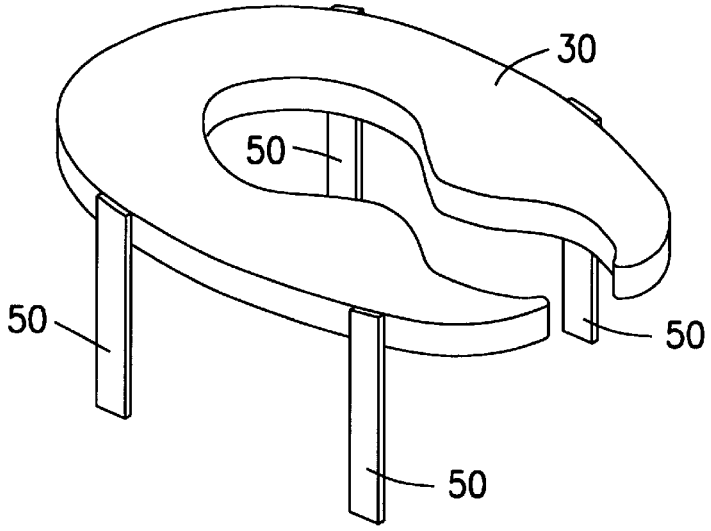
FIG. 5 is a plan view of a bedpan cushion useful in the apparatus of the invention.

In an alternate preferred embodiment, one or more securing tabs 50 can be provided in place of, or in addition to, a retainer, as shown in FIG. 5. Tabs 50 should have a surface which creates frictional resistance when placed in contact with a surface of bedpan 10, such as rim 22. A preferred material is a vinylic polymer. Optionally, a surface of tab 50 can be coated with an adhesive material which will create frictional resistance when placed in contact with a surface of bedpan 10. In such an embodiment, the adhesive surface of tab 50 preferably is maintained against the bottom of cushion 30 until the apparatus is assembled. The number and location of tabs can be varied as desired.

Figure 4:
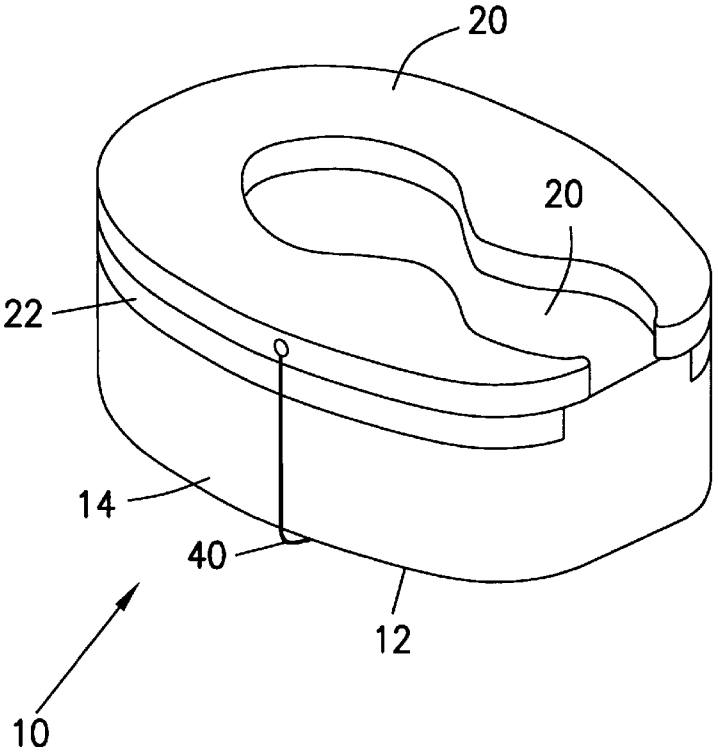
FIG. 4 is a plan view of a bedpan apparatus of the invention.
Figure 6:
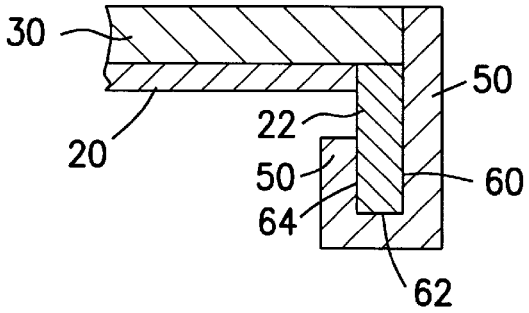
FIG. 6 is a cross-sectional view of a portion of the apparatus of the invention.

In use, cushion 30 is coupled to bedpan 10 to provide support and comfort to a user of the bedpan. The coupling of the cushion and bedpan does not necessarily require that the cushion be affixed to the bedpan, so long as there is a sufficient restriction on displacement of the cushion such that the cushion remains sufficiently on the lip 20 to provide support to the user. Where a retainer 40 is used, cushion 30 is placed on bedpan 10 and retainer 40 is extended around the bottom of the bedpan to retain the assembly, as shown in FIG. 4. Where one or more tabs 50 are employed, the tabs preferably are placed into contact with rim 22. Preferably, tabs 50 are sufficiently long so that they can be wrapped around rim 22 to engage the outer vertical surface 60, bottom edge 62 and at least a portion of the inner vertical surface 64 of the rim, as shown in FIG. 6.

Most preferably, cushion 30 is disposable and intended for single person use. Although bedpan 10 may be disposable, it can be sterilized and re-used. For applications where bedpan 10 is intended to be disposable, cushion 30 can be affixed to the bedpan, such as by adhesive bonding.

I claim:

1. A bedpan apparatus comprising, (a) bedpan having (i) a base and a wall defining a receptacle, and (ii) a lip constructed and arranged to support a person; and (b) a bedpan cushion containing a foam material adjacent to the surface engaged by a user, the cushion being complementary in shape to the lip and coupled to the bedpan on the lip.

2. The apparatus of claim 1, further comprising a retainer connected to the cushion for retaining the cushion on the bedpan lip.

3. The apparatus of claim 2, wherein the retainer is elastic.

4. The apparatus of claim 1, further comprising one or more tabs connected to the cushion and engaging the bedpan for retaining the cushion on the bedpan.

5. The apparatus of claim 4, wherein the bedpan contains a rim extending from the lip, and the tabs engage at least one surface of the rim.

6. The apparatus of claim 5, wherein the rim extends vertically from the lip, and the tabs engage the outer surface, lower edge and inner surface of the rim.

7. The apparatus of claim 6, wherein a surface of the tabs which engages the bedpan contains an adhesive.

8. A bedpan apparatus comprising:

a) a bedpan having (i) a base and a wall defining a receptacle, (ii) a lip constructed and arranged to support a person, and (iii) a rim extending from the lip;

b) a bedpan cushion complementary in shape to the lip and coupled to the bedpan on the lip, the cushion comprising (a) a resilient layer containing a foam material adjacent to the surface engaged by a user and (b) a polymeric layer adhesively bonded to the resilient layer which engages the lip and provides frictional resistance to movement of the cushion; and c) means for retaining the cushion on the lip.

9. An apparatus according to claim 8, wherein the retaining means comprises an elastic material coupled to the cushion and engaging the bedpan.

10. An apparatus according to claim 8, wherein the retaining means comprises at least one tab which engages at least one surface of the rim.

11. The apparatus of claim 10, wherein the rim extends vertically from the lip, and the tabs engage the outer surface, lower edge and inner surface of the rim.

12. The apparatus of claim 10, wherein a surface of the tabs which engages the bedpan contains an adhesive.

13. The apparatus of claim 8, wherein the resilient material is made from a resilient material.

14. A bedpan cushion, comprising two arms complementary in shape to the lip of a bedpan, the bedpan cushion containing a resilient material and means for retaining the cushion on a bedpan.

15. A bedpan cushion according to claim 14, wherein the retaining means is selected from the group consisting of one or both of an elastic retainer and a plurality of adhesive tabs.

16. A bedpan cushion according to claim 15, further comprising a polymeric layer coupled to the resilient material constructed and arranged to provide frictional resistance against a surface of a bedpan.

17. The apparatus of claim 1, wherein the cushion further comprises a polymeric material on the surface opposite that engaged by a person, to provide frictional resistance with the bedpan lip.

* * * * *